United States Patent [19]

Terio

[11] Patent Number: 4,576,507

[45] Date of Patent: Mar. 18, 1986

[54] TERRORIST VEHICLE BARRIER

[76] Inventor: Charles J. Terio, 3171 S. Stafford St., Arlington, Va. 22206

[21] Appl. No.: 675,556

[22] Filed: Nov. 28, 1984

[51] Int. Cl.[4] ..... E01F 13/00

[52] U.S. Cl. ..... 404/6; 49/9; 49/34

[58] Field of Search ..... 404/6; 49/9, 34, 49, 49/131, 133; 244/110 C; 256/1, 13.1

[56] References Cited

U.S. PATENT DOCUMENTS

| | | | |
|---|---|---|---|
| 1,403,750 | 1/1922 | Donovan | 49/9 |
| 1,557,462 | 10/1925 | Leake | 254/4 B |
| 1,603,363 | 10/1926 | Strauss | 49/9 |
| 1,698,424 | 1/1929 | Banschbach | 49/9 |
| 1,848,516 | 3/1932 | Davison | 49/9 |
| 2,088,046 | 7/1937 | White | 49/9 X |
| 2,356,559 | 8/1944 | Banschbach | 49/49 |
| 2,702,953 | 3/1955 | Heinrich | 49/9 |

*Primary Examiner*—Stephen J. Novosad
*Assistant Examiner*—John F. Letchford
*Attorney, Agent, or Firm*—Jeffrey M. Ketchum

[57] ABSTRACT

A terrorist vehicle barrier is disclosed having high strength cables stretched between two vertical I-beams. The cables are attached to the I-beams in a unique shock absorbing arrangement. The barrier is actuatable from a position below ground to effectively arrest the motion of a high speed terrorist vehicle. Various means are disclosed for actuating the gate. The barrier is designed to solve esthetic problems encountered in making a building secure from terrorist attack as well as to be strong enough to stop a high speed vehicle with minimum damage to the barrier, the vehicle, or the vehicle driver.

11 Claims, 9 Drawing Figures

TERRORIST VEHICLE BARRIER

BACKGROUND OF THE INVENTION

In recent years terrorist activity has greatly increased. Particularly popular among terrorists is the technique of loading a vehicle with explosives and driving the vehicle at high speed into a building or installation to blow it up and, and the same time, kill as many people as possible. Attempts to thwart such terrorist activity have included the erection of concrete barriers around buildings, the use of around-the-clock sercurity personnel, etc. The recent success of terrorists indicates that these techniques are ineffective.

Concrete barriers are objected to because of their esthetically unpleasing character. Most buildings that are the object of terrorist attack are designed to be pleasing to the eye and the erection of concrete barriers around such buildings destroys their esthetic character.

SUMMARY OF THE INVENTION

The present invention provides a vehicle barrier of very high strength capable of stopping a high speed vehicle with little damage to the barrier and a minimum of damage to the terrorist vehicle and its driver.

It is an object of the invention to provide a vehicle barrier that is below ground when not in use and quickly actuatable to a raised position when a terrorist vehicle is detected.

It is a further object to provide a unique shock absorbing arrangement capable of stopping a high speed vehicle with a minimum of damage to the barrier, the vehicle, or its driver.

The barrier is comprised of two I-beams that are vertically slidable in guide channels embedded in concrete below the ground. High strength cables are mounted between the spaced I-beams and connected thereto by shock absorbing means. Each shock absorber is rigidly fixed to the I-beams with one part of the shock absorber free to reciprocate to provide a shock absorbing function. A cable is positioned around the shock absorber and attached to the reciprocating portion to form a loop around the shock absorber as well as a loop around the portion of the I-beam. As will be described in detail below, this method of attaching a cable to an I-beam provides a very effective barrier for stopping a high speed vehicle.

DETAILED DESCRIPTION

Figure 8:
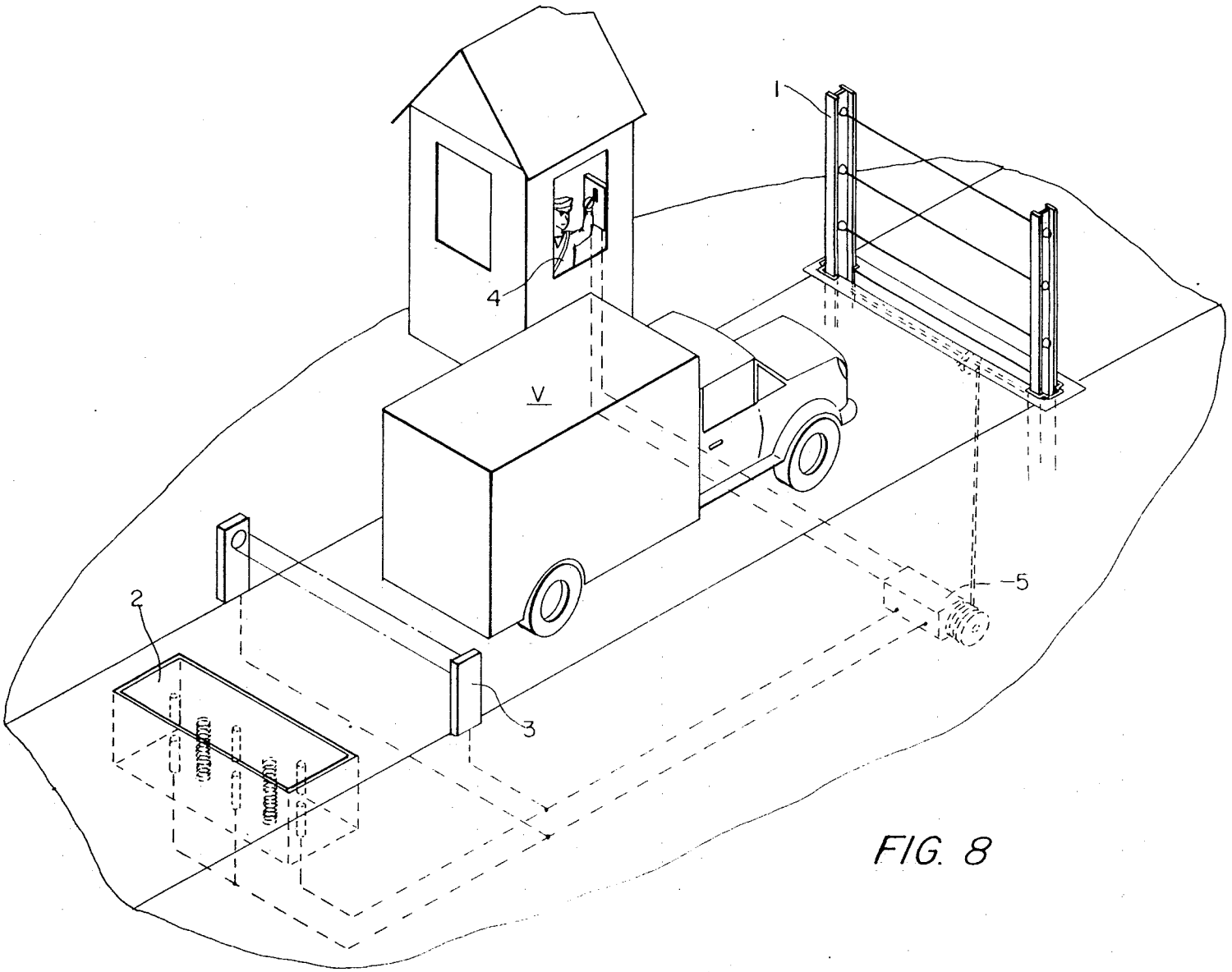
FIG. 8 details the actuating system for raising the gate when a vehicle is detected.

FIG. 8 best shows the overall arrangement of the terrorist vehicle barrier system. The approach of a suspected terrorist vehicle is detected by any suitable means such as a trip plate 2, an electric eye 3, or a visual observer 4. The detecting means are used to actuate the actuator 5 to raise the barrier 1 to stop the vehicle before it reaches its target.

Figure 1:
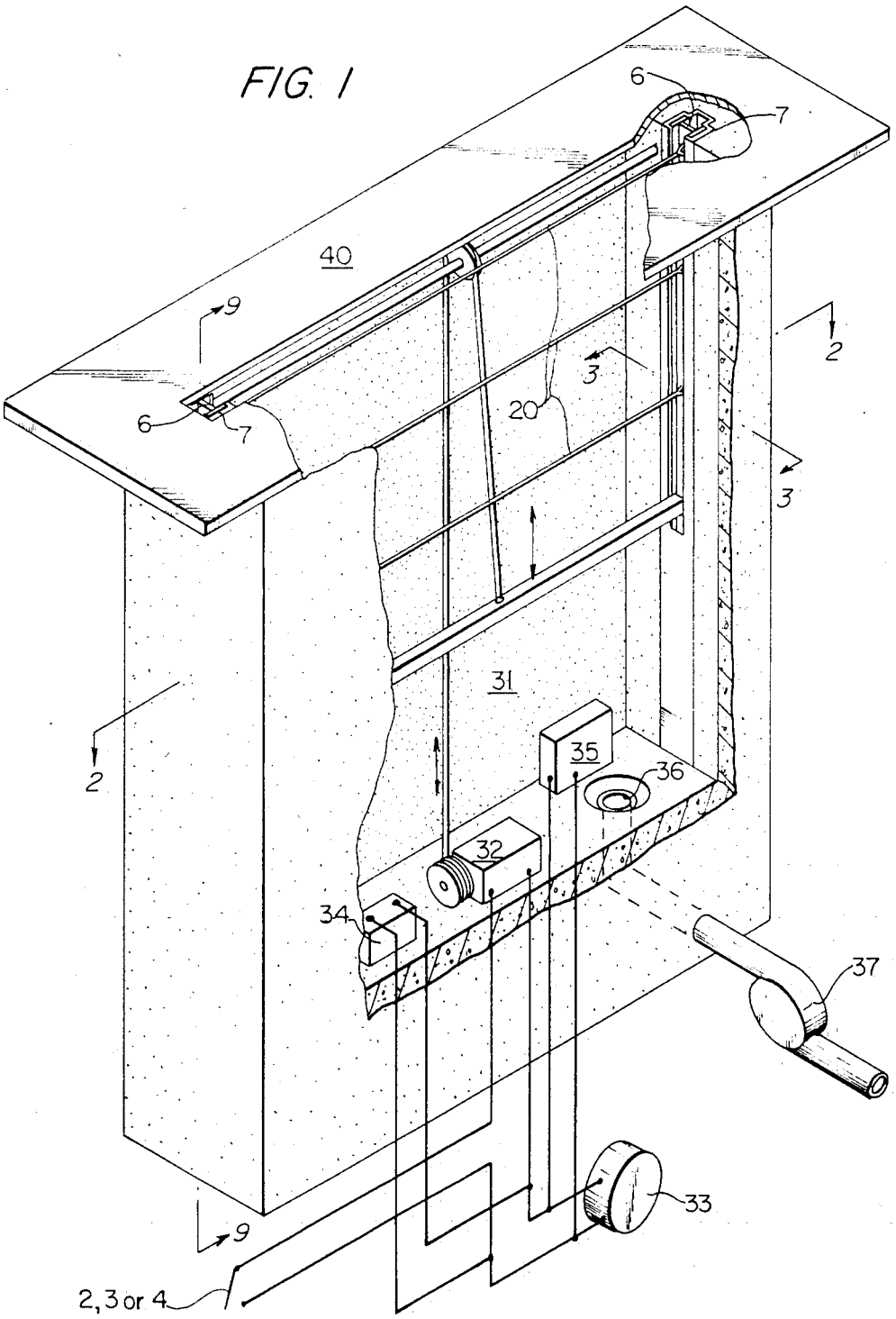
FIG. 1 shows a cut away view of the vehicle barrier of the present invention in its below-ground, storage position.
Figure 3:
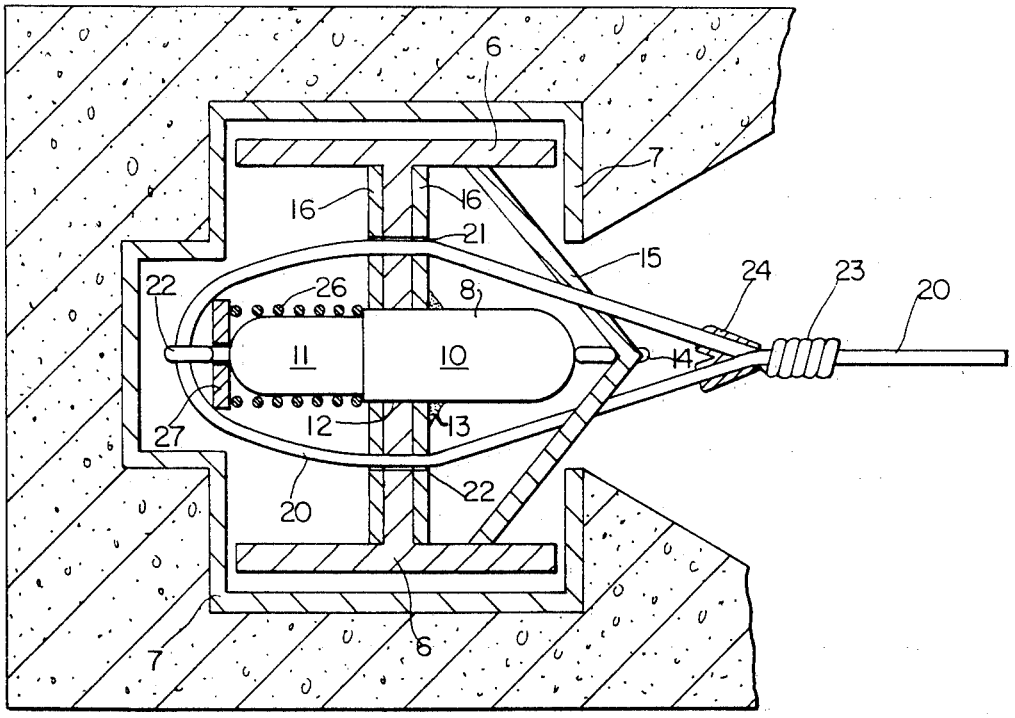
FIG. 3 is a section through line 3—3 of FIG. 1 showing the mounting of the shock absorber on the I-beam in the path of the cable around the shock absorber and through the I-beam.

The barrier itself is best shown in FIG. 1. I-beams 6 are mounted vertically in casings 7 (see FIG. 6 for more detail). Each I-beam has several shock absorbers 8 fixed to it. As shown in FIG. 3, each shock absorber consists of telescoping halves 10 and 11 and are of standard shock absorber structure. The shock absorbers are rigidly mounted to the I beam in an aperture 12 and can be attached either by welding the casing of shock absorber half 10 around the periphery of aperture 12 as shown at 13 or by support means 15 passing through eyelet 14 and connected to the parallel parts of the I-beam. Strengthening plates 16 can be added to the I-beam if necessary.

As can be seen in FIG. 1, steel cables 20 connect opposite shock absorbers and are attached to the shock absorber and I-beam in a manner best shown in FIG. 3. The cable 20 is passed through I-beam 6 by means of aperture 21, is passed through eyelet 22 connected to the reciprocating part of shock absorber 8, and then is passed through a second aperture 22 through the I-beam. The cable is next wrapped back around itself as shown at 23 in FIG. 3. A suitable cable clamp 24 is used to retain the loop.

As can clearly be seen in FIG. 3, the cable 25 not only loops around the shock absorber but also loops around the central portion of the I-beam. In case the shock absorber should fail the I beam will still function to retain the loop and, thereby, stop the terrorist vehicle. An auxiliary spring 26 can be included to assist in the shock absorbing function. A spring abutment plate 27 confines one end of the spring and I-beam 6 or one of the strengthening plates 16 confines the other end of the spring. The shock absorber 8 and the spring 26 can be chosen to provide any desired degree of shock absorbing capability.

Figure 2:
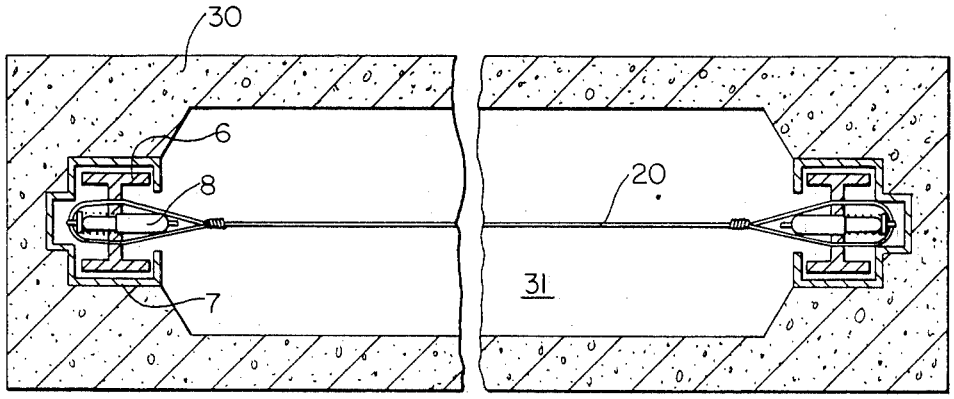
FIG. 2 is a cross-section along line 2—2 of FIG. 1.
Figure 4:
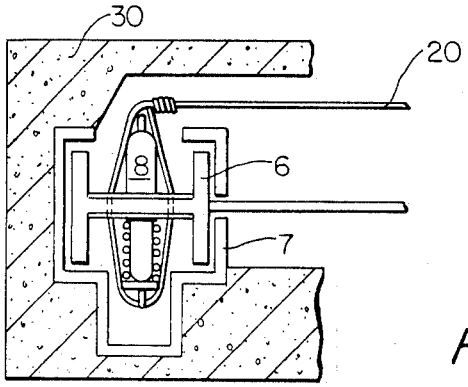
FIG. 4 shows an alternate orientation of the I-beam and the concrete pit.
Figure 5:
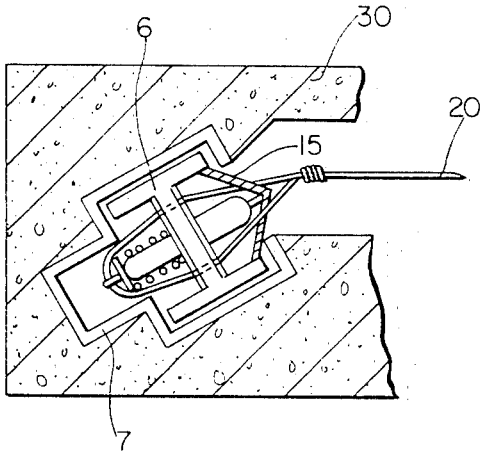
FIG. 5 is another orientation of the I-beam and casing in the concrete pit.

FIG. 3 shows the shock absorber mounted with its longitudinal axis virtually the same as the line defined by the cable stretched between the two I-beams. FIG. 2 shows the same alignment. The I-beam and casing can also be oriented as shown in FIGS. 4 and 5. FIG. 5 provides the optimal orientation because the resultant force on the shock absorber from impact on cable 20 by a high speed vehicle will be placed on the longitudinal axis of the shock absorber and is best absorbed by such an angled orientation. This optimum angle is determined by the distance between the spaced vertical I-beams i.e. the length of cable 20.

Figure 6:
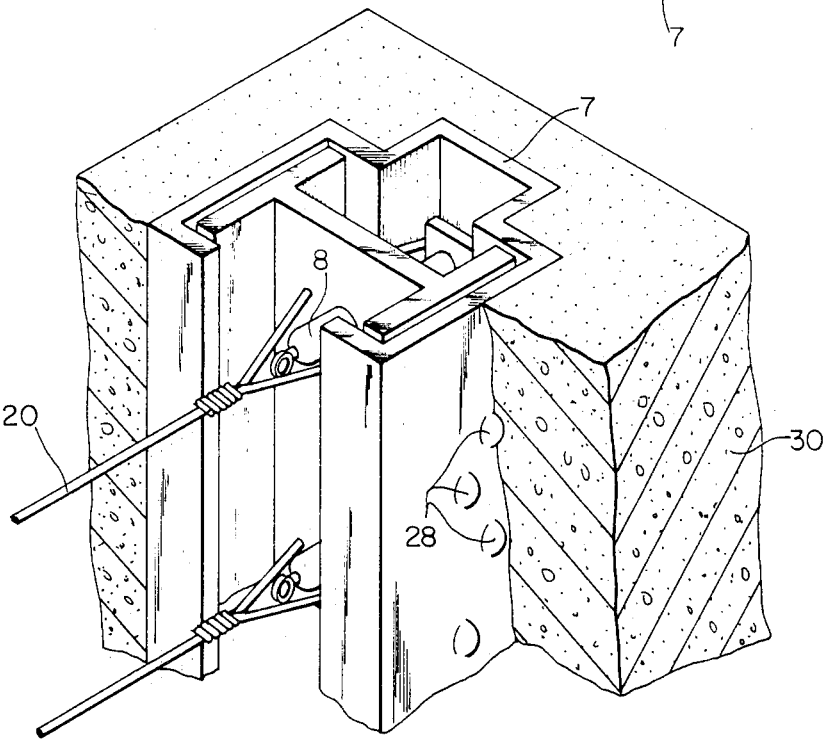
FIG. 6 is a cut away view of the I-beam and casing.
Figure 9:
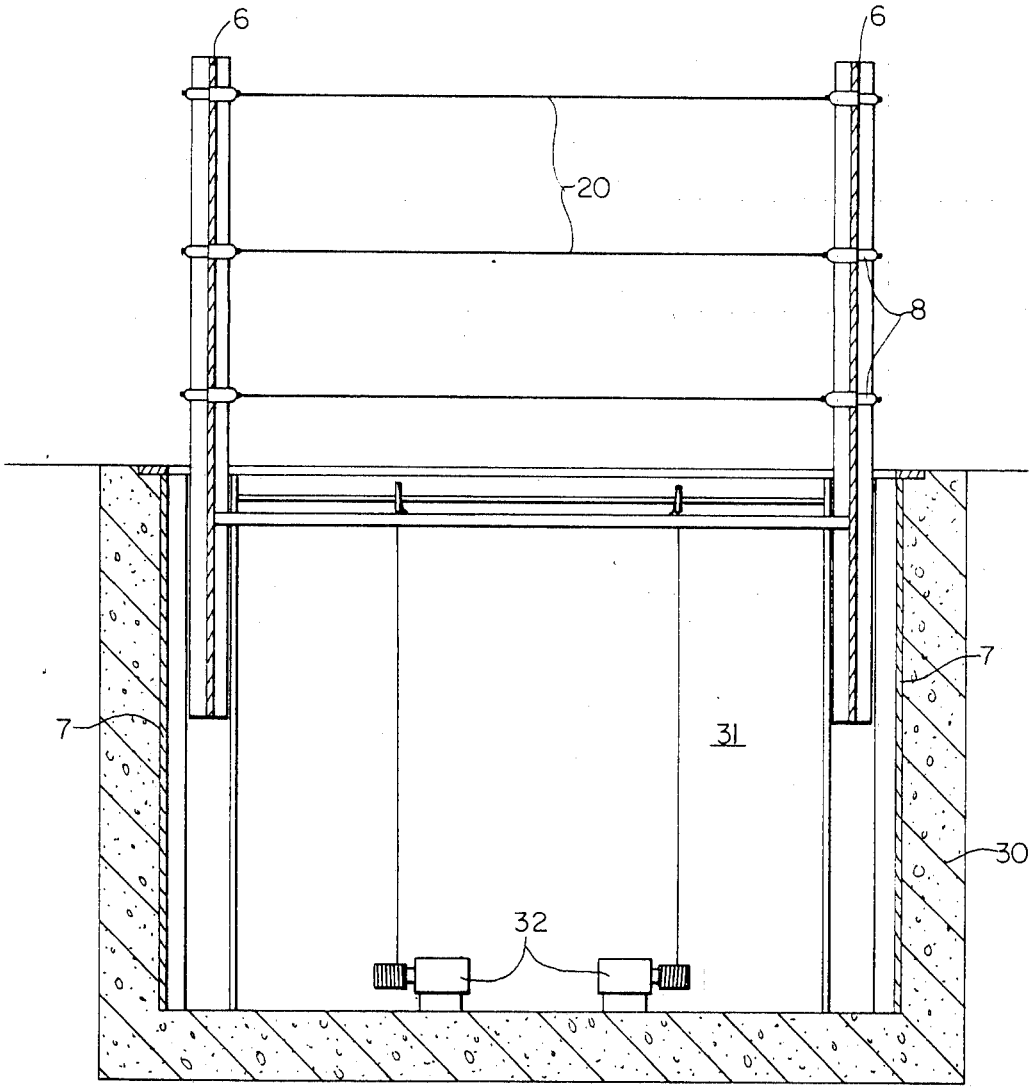
FIG. 9 is a vertical section along line 9—9 of FIG. 1.

The installation of the barrier in the ground can best be described with relation to FIGS. 1, 6, 7, and 9. Steel casings 7, best shown in FIG. 6, are shaped to guide the I beam and to provide a housing for the shock absorbers. The casings have dimples 28 which serve to anchor the casing in the concrete pit generally indicated by numeral 30 in FIG. 1. The concrete pit includes an open area 31 to accommodate the cables 20 when the vehicle barrier is located below ground as well as to accommodate the operating means for the barrier. FIGS. 1 and 9 show winches 32 used to operate the barrier. Any suitable operating means can be used including winches, a counterweight system, explosive means, or any other suitable actuating means.

Whatever the actuating means, a primary and secondary power source can be used. FIG. 1 shows an AC source 33 and a DC battery 34 as a backup to the AC source. The AC source 33 charges battery 34 in addition to operating the winch 32 so that if the AC source fails the battery 34 will operate the barrier. The AC source 33 or the battery 34 could also be used to activate an explosive charge to drive the barrier to its up position quickly since the approach of a terrorist vehicle is usually at very high speed with little warning given.

FIG. 1 also shows heater 35 used to ensure proper operation of the barrier in cold weather. Drain 36 connected to pump 37 keeps the concrete pit dry.

FIG. 1 also shows a cover plate 40 used to conceal the barrier when in its non-use position. This cover plate 40 pivots out of the way when the barrier is actuated and can hopefully be replaced in its original position after the barrier is replaced in the ground after use.

Figure 7:
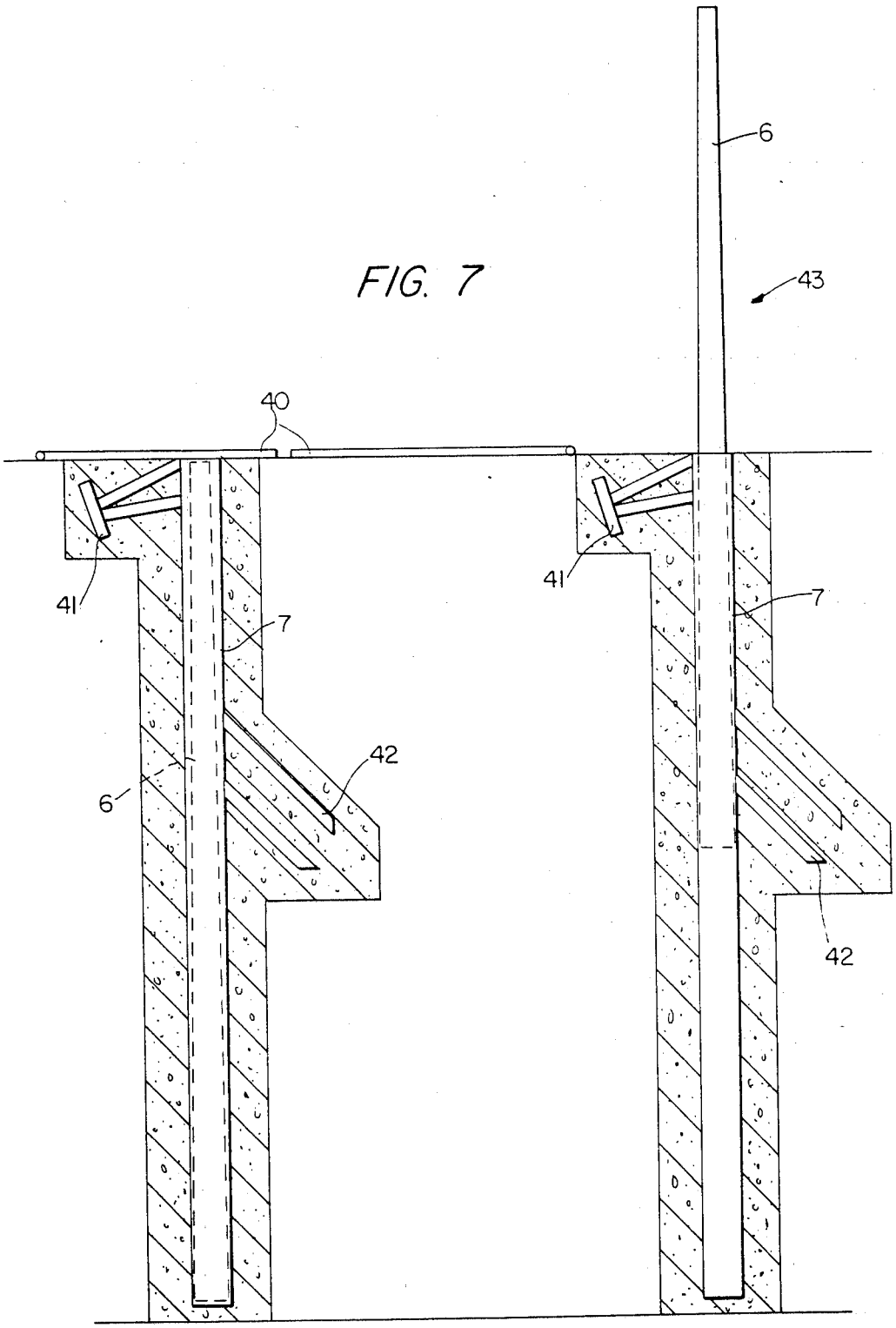
FIG. 7 shows a vertical section of two of the vehicle barriers, one in a storage position, the other in the raised or use-position.

FIG. 7 shows two vehicle barriers, one in the ground, the other actuated to the up position. Cover plate 40 is shown pivoted out of the way when the barrier is actuated. FIG. 7 also shows upper and lower I-beam reinforcement 41 and 42, respectively. When the vehicle barrier is in the up position, the reinforcements 41 and 42 provide a cantilever support so that when a vehicle approaches in the direction of arrow 43 the I-beam is fully supported in addition the support provided by casing 7.

As can be seen from the foregoing description, the vehicle barrier is completely hidden in the ground prior to actuation. A plurality of the barriers can be employed in a staggered relationship to effectively seal off even a large entrance area. The problem of an esthetically pleasing barrier is eliminated by having the barrier completely out of view when not in use. Also, the barrier is constructed to be extremely strong and resilient so minimum damage will occur to the barrier when impacted by a high speed vehicle. The barrier can, therefore, be replaced in the ground after being impacted by a high speed vehicle with little or no repair.

It is also envisioned that the barrier can be placed in a structure above the path of a vehicle and lowered into position to stop the vehicle.

I claim:

1. A vehicle barrier comprising:

a pair of spaced upright supports positionable in the path of a vehicle, at least one pair of opposed shock absorbers having telescoping inner and outer portions, one of said pair attached to one of said supports, the other of said pair attached to the other said support, each said shock absorber mounted in a first aperture in one of said supports, one said portion fixed to said support, the other said portion free to reciprocate in said one portion, and cable means connecting said at least one pair of shock absorbers, said cable means passing through a second aperture in said support adjacent said shock absorber, attaching to said reciprocating portion of said shock absorber, and passing through a third aperture in said support adjacent said shock absorber and opposite said second aperture to join itself to provide a loop around said shock absorber and around a portion of said support.

2. The vehicle barrier of claim 1 wherein said upright supports are I-beams.

3. The vehicle barrier of claim 1 wherein said barrier is located in a position above the path of a vehicle and is lowered to its use position to stop the vehicle.

4. The vehicle barrier of claim 1 wherein said barrier is located entirely below ground in its non-use position, is housed in a concrete pit, and includes operating means in said pit for raising said barrier to its use position.

5. The vehicle barrier of claim 4 further including:

pump means for removing water from said pit; and heating means for cold weather operation.

6. The vehicle barrier of claim 4 wherein said operating means is at least one electric winch, said winch having a power source including an AC source and a back-up DC source used in the event the AC source fails; and said DC source including a storage battery operable in the event said DC source is tampered with.

7. The vehicle barrier of claim 4 wherein said operating means is actuated by sensing means capable of sensing the presence of an approaching vehicle.

8. The vehicle barrier of claim 4 wherein said operating means is actuated by a manual switch operated by a visual observer.

9. The vehicle barrier according to claim 4 wherein said operating means comprises at least one explosive charge to quickly raise said barrier.

10. A terrorist vehicle barrier comprising:

a pair of spaced vertical I-beams mounted for reciprocation in guide channels, said guide channels located below ground in a concrete pit;

at least one pair of expansible chamber type shock absorbers having telescoping inner and outer halves, one of said pair attached to one of said I-beams, the other of said pair attached to said other I-beam, each said shock absorber mounted in a first aperture in said I-beam, one of each of said telescoping halves fixed to said I-beams in said first aperture, the other half free to reciprocate;

cable means connecting shock absorbers of each said pair, said cable means passed through a second aperture adjacent said first aperture in said I-beam, attached to said inner reciprocating other half of said shock absorber and passed back through said I-beam through a third aperture adjacent said first aperture opposite said second aperture and joined to itself to form a loop around said shock absorber and a loop around a portion of said I-beam; and means for raising said barrier to its use position.

11. The barrier of claim 10 further including;

means for raising said barrier;

multiple power sources for said raising means;

pump means in said pit for removing water; and heating means in said pit for cold weather operation.

* * * * *